US005893329A

United States Patent [19]

Klimmer

[11] Patent Number: 5,893,329

[45] Date of Patent: Apr. 13, 1999

[54] SYSTEM FOR THE TRANSPORTATION OF PERSONS AND/OR OF GOODS

[75] Inventor: Alexander Klimmer, Wolfurt, Austria

[73] Assignee: Konrad Doppelmayr & Sohn Maschinenfabrik m.b.H. & Co. KG, Wolfurt, Austria

[21] Appl. No.: 08/824,445

[22] Filed: Mar. 26, 1997

[30] Foreign Application Priority Data

Mar. 26, 1996 [AT] Austria ..... 551/96

[51] Int. Cl.[6] ..... B61B 12/00

[52] U.S. Cl. ..... 104/178; 104/249; 104/173.1; 104/21

[58] Field of Search ..... 104/18, 21, 168, 104/173.1, 178, 179, 184, 249, 250, 60

[56] References Cited

U.S. PATENT DOCUMENTS

| | | | |
|---|---|---|---|
| 4,627,361 | 12/1986 | Tarassoff | 105/178 |
| 4,744,306 | 5/1988 | Kunczynski | 104/173.1 |
| 4,843,970 | 7/1989 | Feuz | 104/21 |
| 4,942,823 | 7/1990 | Meindl | 104/178 |
| 4,991,514 | 2/1991 | Powell et al. | 104/60 |

FOREIGN PATENT DOCUMENTS

| | | | |
|---|---|---|---|
| 2605961 | 5/1988 | France | 104/178 |

*Primary Examiner*—Mark Tuan Le
*Attorney, Agent, or Firm*—Herbert L. Lerner; Laurence A. Greenberg; Werner H. Stemer

[57] ABSTRACT

Persons and/or goods are transported in vehicles which are each equipped with running wheels. The vehicles are connectable to a continuously driven traction cable by which they are driven along a track, such as on rails. A plurality of deceleration wheels and a plurality of acceleration wheels disposed in stations of the system where the vehicles may be loaded and unloaded. In the stations, the vehicles are disconnectable from the traction cable. The vehicles are slowed down by bringing the deceleration wheels into contact therewith and they are accelerated by bringing the acceleration wheels into contact therewith. The deceleration wheels are divided into a plurality of groups and the wheels within each group are driven at the same peripheral speed. Upon transfer of the vehicle from one group of wheels to an adjacent group, the wheels of the two groups are driven at the same speed as well.

11 Claims, 4 Drawing Sheets

SYSTEM FOR THE TRANSPORTATION OF PERSONS AND/OR OF GOODS

BACKGROUND OF THE INVENTION

FIELD OF THE INVENTION

The present invention relates to a system for transporting persons and/or goods in a plurality of vehicles each equipped with running wheels; the vehicles are connectable to a continuously moving traction cable whereby they can be driven along a track, specifically along rails, wherein there are deceleration and/or acceleration wheels in boarding areas and/or alighting stations where the vehicles can be disconnected from the traction cable; the deceleration and/or acceleration wheels can be brought into contact with the vehicles, whereby their driving speed is reduced or increased.

A system of that type is disclosed in European patent publication EU A1 673 817, wherein the vehicles—after the passengers have boarded the vehicle at the first station—are brought up to the speed of the traction cable by means of the acceleration wheels and then they latch on to the traction cable. They are then conveyed to the second station by means of the traction cable, which moves at a speed of, for instance, 8 m/sec. In the second station, the vehicles, after having been disconnected from the traction cable, are slowed down by means of the deceleration wheels to a speed of less than 0.5 m/sec, such that the passengers can board or alight from them.

This technique is already known from cable car systems, hereby the successive wheels are driven in the segments of acceleration and deceleration at decreasing and increasing peripheral speeds respectively, wherein only one acceleration wheel or deceleration wheel takes effect at any one time on the running gear of the cable car. However, it is not possible to transfer this technique to systems having vehicles that are several meters in length because this would require extremely long deceleration and acceleration segments.

For this reason, it would appear possible to drive all the wheels of the deceleration segment or of the acceleration segment at the same decreasing or increasing peripheral speeds, wherein the peripheral speed of the deceleration wheels—after these take over the vehicles that have been disconnected from the traction cable—is reduced from the speed of the traction cable to that speed at which the passengers can board or alight from the vehicles, or, in case of transfer of the vehicles from the boarding/alighting area, the peripheral speed of the acceleration wheels is increased from the boarding/alighting speed to the speed of the traction cable, at which point the vehicles can be connected to the traction cable. However, the drawback with this technique is that only one vehicle can be in the segments for deceleration or for acceleration at any one time, which greatly limits the number of vehicles that can be operated in such a system.

SUMMARY OF THE INVENTION

It is accordingly an object of the invention to provide a system for the transportation of persons and/or goods, which overcomes the above-mentioned disadvantages of the heretofore-known devices and methods of this general type and which is enabled to slow a plurality of vehicles at the same time, and wherein the number of vehicles in the system can be increased to a considerable extent.

With the foregoing and other objects in view there is provided, in accordance with the invention, a system for transporting persons and goods, comprising:

a plurality of vehicles each equipped with a plurality of running wheels, a continuously driven traction cable to which the vehicles are individually connectable, and a track along which the vehicles are driven by the traction cable;

a plurality of deceleration wheels and a plurality of acceleration wheels disposed in stations of the system, where the vehicles are disconnectable from the traction cable, and where the deceleration wheels and the acceleration wheels are brought into contact with the vehicles for respectively decelerating and accelerating the vehicles;

the plurality of deceleration wheels being divided into a plurality of groups of wheels, the deceleration wheels within each of the groups being driven at a substantially identical peripheral speed, and, at an instance when a respective the vehicle is transferred from one of the groups of wheels to an adjacent one of the groups of wheels, the wheels of both the groups of wheels having a substantially identical peripheral speed.

In other words, the objects of the invention are satisfied in that the deceleration wheels are divided into a plurality of groups, wherein the individual wheels within one group are each driven at the same peripheral speed, which decreases for slowing the vehicle, and, during a transfer of a vehicle from one group to the adjacent group, the wheels of both groups are at the same peripheral speed.

Through the subdivision of the deceleration wheels in the deceleration segment into a plurality of groups, the wheels within the groups being driven at the same decreasing peripheral speeds, each group of wheels can drive one vehicle, a fact that increases considerably the possible number of vehicles in the system. In this way, the capacity of such a system increases with the number of groups of deceleration wheels.

In accordance with another feature of the invention, the acceleration wheels are also divided into a plurality of groups, wherein the individual wheels within a group are each driven at the same peripheral speed, which increases, and, during the transfer of a vehicle from one group to the next group, the wheels of both groups are at the same peripheral speed.

In accordance with an added feature of the invention, the individual groups of wheels are disposed at a defined distance from each other, the distance being equal to at least half the length of a vehicle.

In accordance with a preferred embodiment, the first group of deceleration wheels comprises a plurality of at least ten wheels wherein these wheels are driven during transfer of a vehicle at a peripheral speed equal to the speed of the traction cable, e.g. 8 m/sec, which is subsequently reduced to a speed of 2 m/sec to 1 m/sec. Furthermore, in a preferred embodiment, the last group of acceleration wheels comprises a plurality of at least ten wheels, wherein these wheels are driven during transfer of a vehicle from the preceding group at a peripheral speed of 1 m/sec. to 2 m/sec., which is subsequently increased to the speed of the traction cable, e.g. 8 m/sec.

The terms "first" and "last" are used herein in the context of the travel direction of the vehicles through the stations, where the first group of deceleration wheels is the first group of wheels coming in contact with the vehicle (entering the station) after being disconnected from the traction cable, and the last group being the last group of wheels before the vehicle is connected to the traction cable and thus leaves the station at its travel speed.

Preferably, the second group of deceleration wheels is driven during transfer of a vehicle from the first group of deceleration wheels at a peripheral speed of 2 m/sec. to 1 m/sec., which is subsequently reduced to a speed of less than 0.5 m/sec., at which speed passengers can board or alight from the vehicles, followed by a group of wheels being driven during transfer of a vehicle at a peripheral speed of less than 0.5 m/sec., whereupon their speed is increased to approximately 2 m/sec. Furthermore, the wheels designed for the boarding and alighting area are preferably driven at a constant peripheral speed of less than 0.5 m/sec. This can also be brought to a standstill for the boarding or alighting of passengers.

In accordance with another preferred embodiment, there is provided a turntable in the terminal stations of the system between the segments of the deceleration wheels and the acceleration wheels. The turntable enables turning the vehicles from one segment in one direction to another segment in the opposite direction.

Other features which are considered as characteristic for the invention are set forth in the appended claims.

Although the invention is illustrated and described herein as embodied in system for the transportation of persons and/or of goods, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
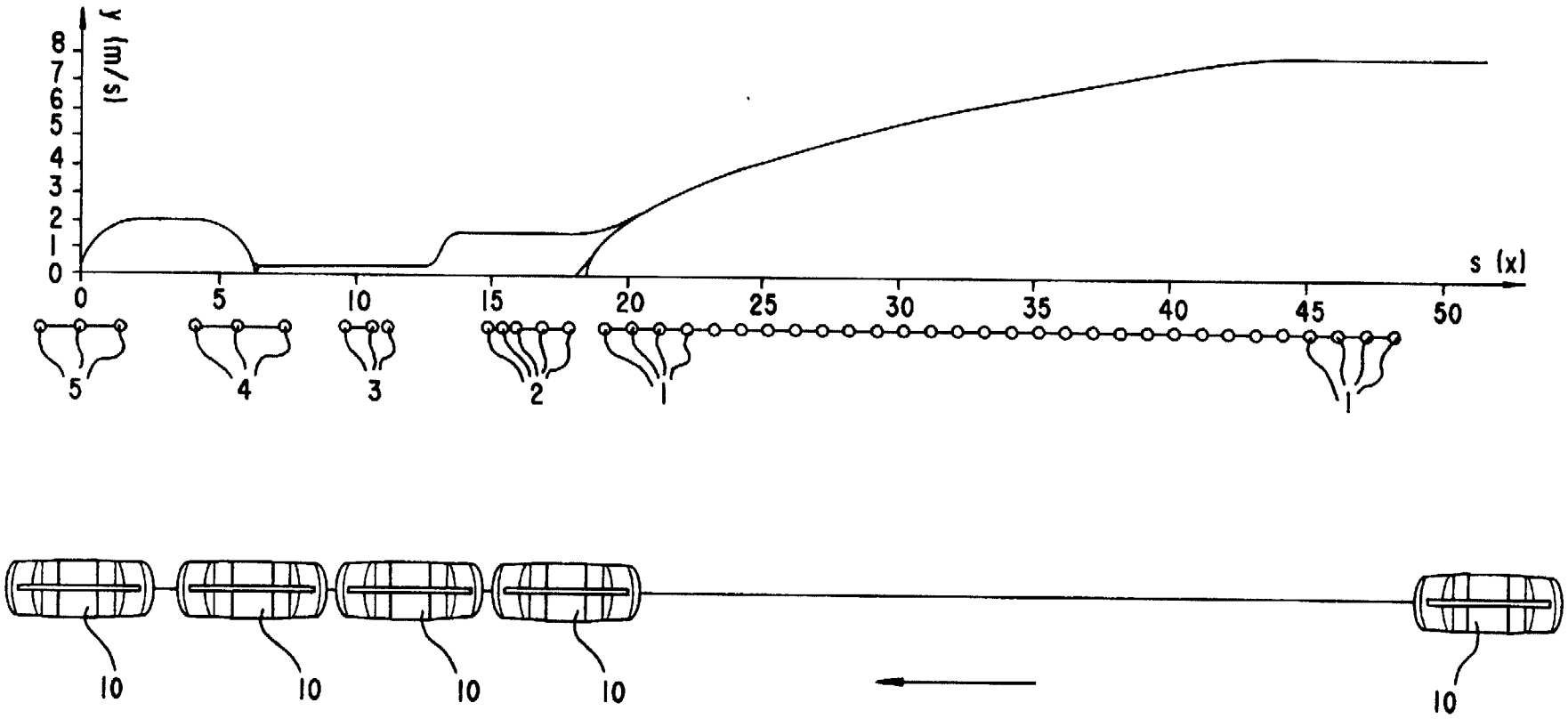
FIG. 1 is a schematic top-plan view of a system in accordance with the invention, together with a velocity diagram.

Referring now to the figures of the drawing in detail and first, particularly, to FIG. 1 thereof, there is seen a system in accordance with the invention which comprises a track along which vehicles with wheels are conveyed by means of a traction cable or drive cable. The traction cable is driven, by way of example, at a constant speed of 8 m/sec. The vehicles are connectable to the traction cable. In order to permit the passengers to board/alight from these vehicles, the vehicles are disconnected from the traction cable in the boarding and/or alighting stations and are reduced in speed by means of deceleration wheels to less than 0.5 m/sec, wherein they can also be brought to a complete standstill.

As soon as the passengers have boarded or alighted from the vehicles, the speed of the vehicles is increased through the acceleration wheels to the speed of the traction cable, whereupon they are connected to this and conveyed at a constant speed through the traction cable as far as the next boarding and/or alighting station.

The velocity diagram of FIG. 1 shows the peripheral speed of the deceleration wheels in the individual sections of the deceleration segment illustrated in the lower half of FIG. 1.

The deceleration segment comprises two groups of deceleration wheels, followed by three groups of driving wheels. The individual wheels in these groups are each driven at the same peripheral speeds. The deceleration segment comprises a first group having a plurality of deceleration wheels 1, which are driven during the transfer of the vehicles 10 from the traction cable at a peripheral speed of approximately 8 m/sec. As soon as vehicle 10 is disconnected from the traction cable, it is taken up by the deceleration wheels 1, the peripheral speed of which is then reduced to approximately 2 m/sec.

Following the first group of deceleration wheels 1 is a second group of deceleration wheels 2, which are also driven during the transfer of vehicle 10 from the deceleration wheels 1 at a peripheral speed of approximately 2 m/sec. Their peripheral speed is subsequently reduced to less than 0.5 m/sec. This group of deceleration wheels 2 is followed by a group of wheels 3, which are always driven at a constant speed of less than 0.5 m/sec. The driving wheels 3 are disposed in the same area at which passengers board/alight from vehicles 10. These are followed by a fourth group of driving wheels 4, through which vehicles 10 are conveyed to a turntable, on which they are turned by means of driving wheels 5. The turntable turns vehicles 10 by 180°. They are subsequently conveyed in an acceleration segment.

Figure 1A:
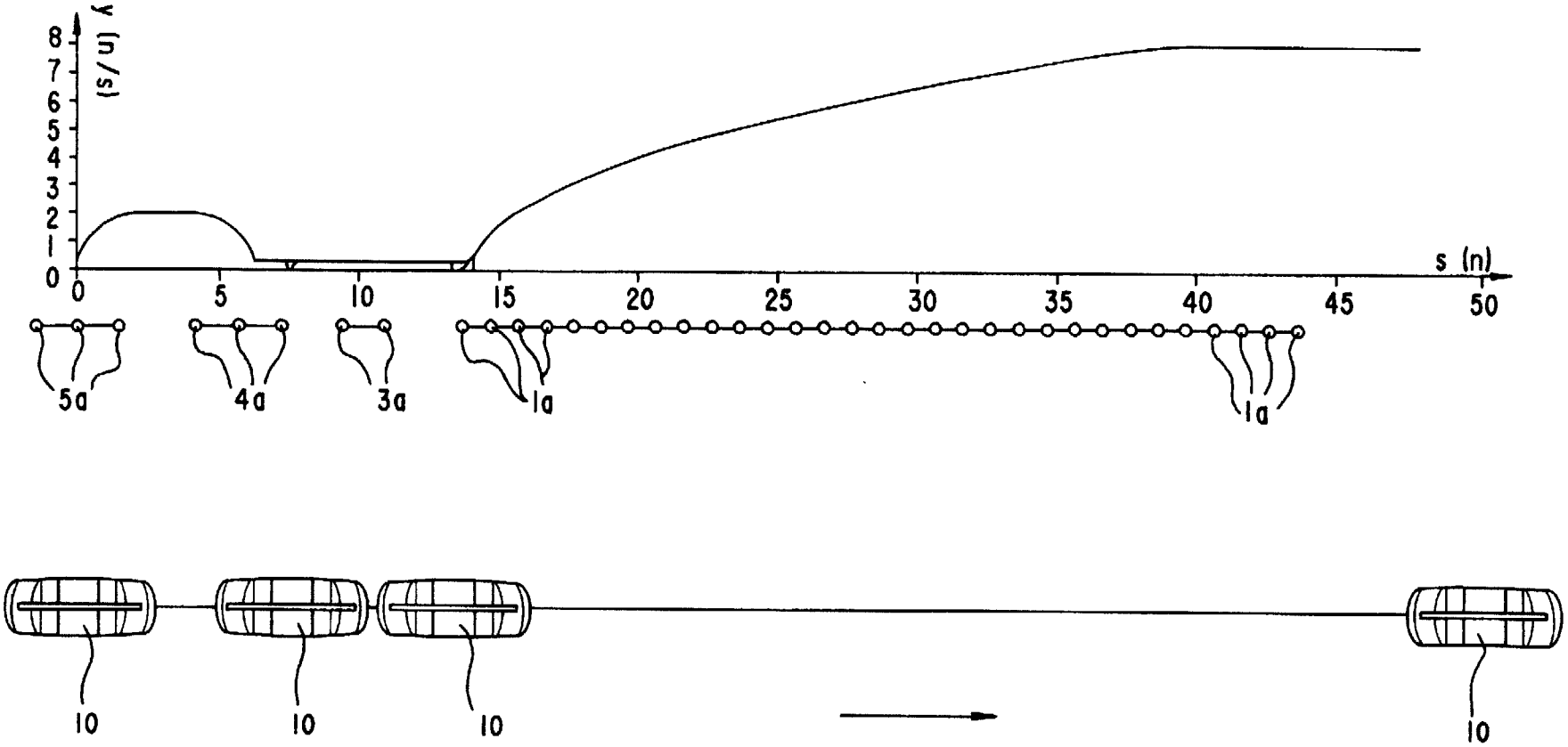
FIG. 1*a* is a similar schematic illustration of the acceleration segment of a system in accordance with the invention, together with a velocity diagram.

As shown in FIG. 1*a*, the acceleration segment also comprises a plurality of groups of wheels 5*a*, 4*a*, 3*a* and 1*a*, the wheels of which are each driven at the same peripheral speed. During transfer of the vehicle 10 from one group to the next group, the wheels of the successive groups are driven at the same peripheral speeds.

The wheels 5*a* and 4*a* convey the vehicles 10 from the turntable into the boarding area, where they are conveyed by means of wheels 3*a* at a peripheral speed of less than 0.5 m/sec. At that speed it is safe for the passengers to board the vehicles. The vehicles 10 are subsequently taken up by the acceleration wheels 1*a*, which are driven during the transfer of the vehicles at a peripheral speed of less than 0.5 m/sec. Their peripheral speed is subsequently increased to approximately 8 m/sec., whereby vehicles 10 can be connected at the end of the acceleration segment to the traction cable being conveyed at this speed.

Through the fact that the deceleration segment comprises a plurality of groups of deceleration wheels, the entrance area into a boarding and/or alighting station is divided into a plurality of sections, wherein one vehicle 10 can be located in each section. The capacity of such a system thereby increases with the number of sections in the deceleration segment.

Figure 2:
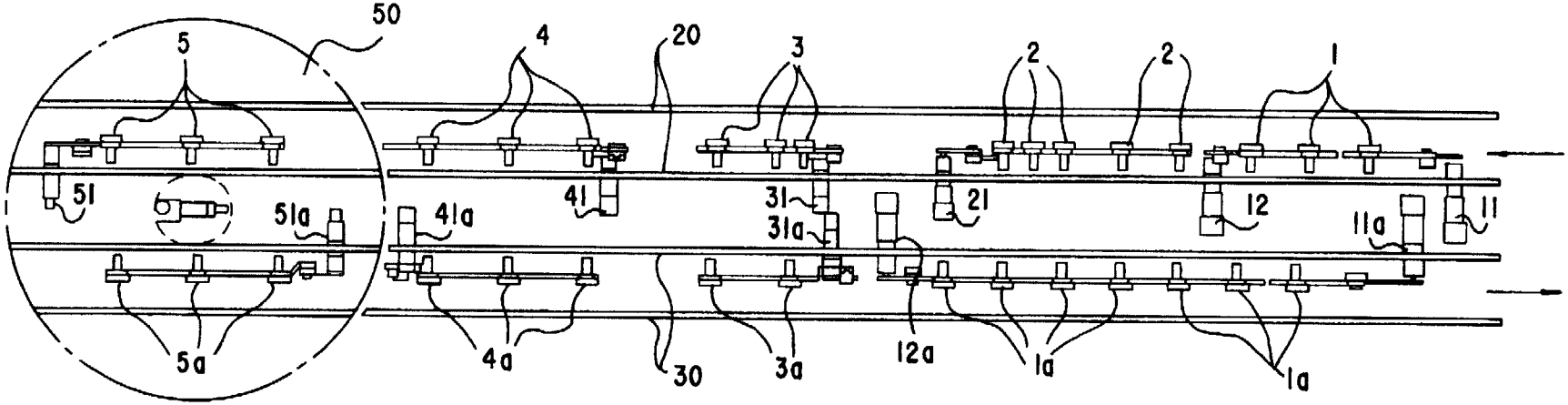
FIG. 2 is a plan view of the deceleration segment and of the acceleration segment.
Figure 2A:
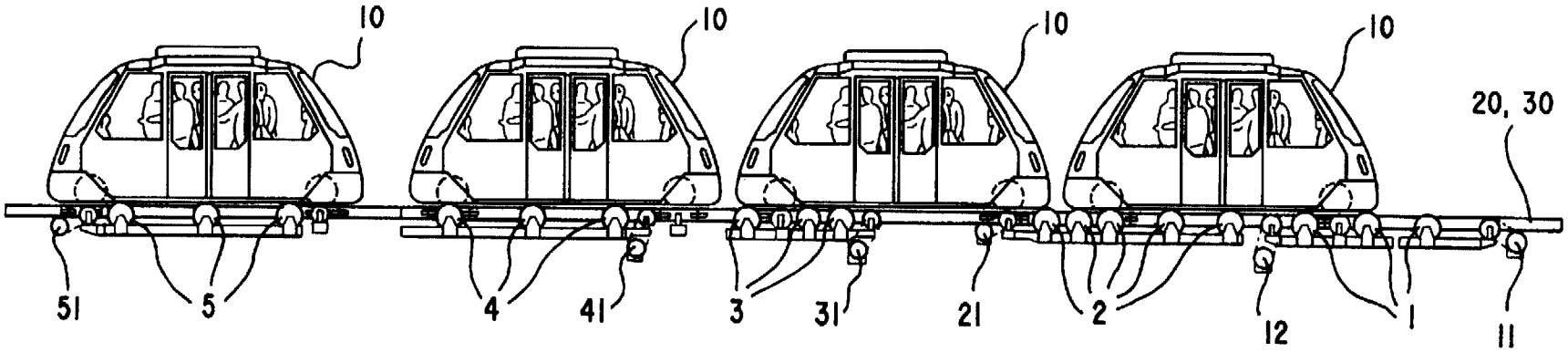
FIGS. 2*a* and 2*b* are side elevational views of the deceleration segment and the acceleration segment.
Figure 2B:
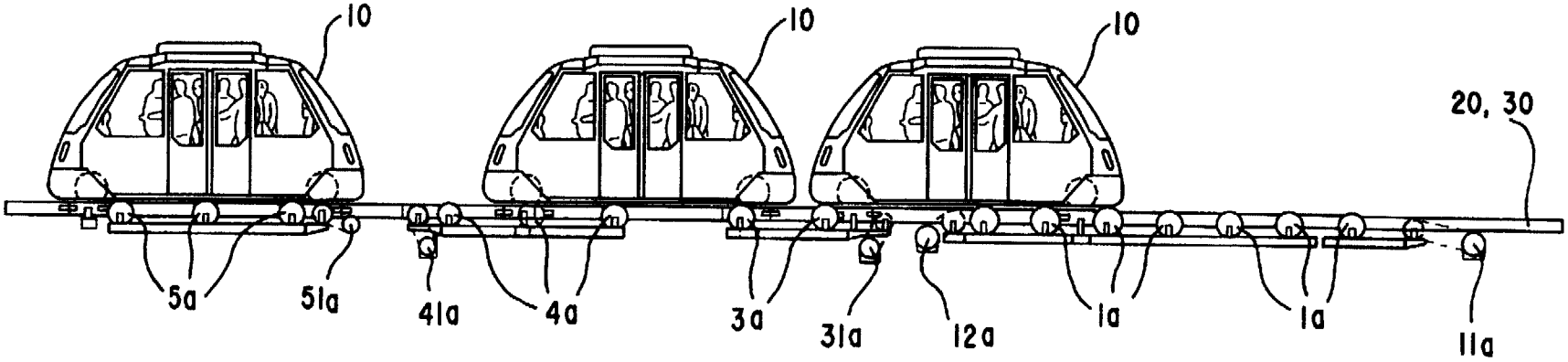

The structural layout of a terminal station of such a system is explained below, using FIGS. 2, 2*a* and 2*b*.

As shown, such a system comprises the first group of deceleration wheels 1, which are driven by motors 11 and 12 via V-belts at the same rotational speeds. After a vehicle 10 is disconnected from the traction cable, which is conveyed at a constant speed of approximately 8 m/sec., the peripheral speed of the deceleration wheels 1 is reduced to approximately 2 m/sec. Vehicle 10 then reaches the second group of deceleration wheels 2, which are driven via V-belts by a motor 21. The deceleration wheels 2 reduce the speed of vehicle 10 to less than 0.5 m/sec., at which speed it is transferred to wheels 3, which are disposed in the area of the alighting station. Vehicle 10 is conveyed through this area at a constant speed of less than 0.5 m/sec. Vehicle 10 is subsequently conveyed to a turntable 50 by means of the fourth group of wheels 4, which are driven by a motor 41 via V-belts, on which turntable are wheels 5 being driven by a motor 51.

After turntable 50 turns by 180°, vehicle 10 is conveyed by means of wheels 5*a*, which are driven by a motor 51*a*, into the acceleration segment, where it is conveyed by means of wheels 4*a* and 3*a*, driven by motors 41*a* and 31*a*, into the boarding area, through which it is driven at a speed of less than 0.5 m/sec. The vehicle is then accelerated by means of acceleration wheels 1*a*, driven by a motor 11*a*, to 8 m/sec., whereupon it can be connected to the traction cable being driven at a constant speed of 8 m/sec. Vehicles 10 are driven along to rails 20 and 30.

If the alighting area is located at the end of such a system, vehicle 10 is turned by 180° by means of turntable 50, whereby it is subsequently conveyed in the opposite direction. However, if the boarding and/or alighting area is located in the course of the line of such a system, vehicles 10 do not need to be turned, but are decelerated after being disconnected from the traction cable and, if necessary, brought to a standstill, such that the passengers can board/alight from them, and are subsequently accelerated in the same direction to such an extent that they can be connected again to the traction cable.

What is important is that the deceleration wheels, and possibly also the acceleration wheels, are divided into a plurality of groups, that all wheels in the individual groups are driven at the same speed in each case, and that the driving wheels of two successive groups are at the same speed during transfer of a vehicle from one group to the next group.

I claim:

1. A system for transporting persons and goods, comprising:

a plurality of vehicles each equipped with a plurality of running wheels, a continuously driven traction cable to which said vehicles are individually connectable, and a track along which said vehicles are driven by said traction cable;

a plurality of deceleration wheels and a plurality of acceleration wheels disposed in stations of the system, where said vehicles are disconnectable from said traction cable, and where said deceleration wheels and said acceleration wheels are brought into contact with said vehicles for respectively decelerating and accelerating said vehicles;

said plurality of deceleration wheels being divided into a plurality of groups of wheels, said deceleration wheels within each of said groups being driven at a substantially identical peripheral speed, while said wheels in different groups are generally driven at mutually different peripheral speeds, and, at an instance when a respective said vehicle is transferred from one of said groups of wheels to an adjacent one of said groups of wheels, said wheels of both said groups of wheels having a substantially identical peripheral speed.

2. The system according to claim 1, wherein said acceleration wheels are divided into a plurality of groups of acceleration wheels, said acceleration wheels within each of said groups of acceleration wheels being driven at a substantially identical peripheral speed, and, at an instance when a respective said vehicle is transferred from one of said groups of acceleration wheels to an adjacent one of said groups of acceleration wheels, said wheels of both said groups of acceleration wheels having a substantially identical peripheral speed.

3. The system according to claim 1, wherein said vehicles have a given length, and said groups of deceleration wheels being spaced apart from one another by at least half said given length.

4. The system according to claim 1, wherein said traction cable is driven at a given traction cable speed, and wherein a first group of said groups of deceleration wheels includes at least ten wheels, said wheels of said first group being driven at a peripheral speed equal to the given traction cable speed during a transfer of a respective one of said vehicles onto said first group.

5. The system according to claim 4, wherein the given traction cable speed is approximately 8 m/sec, and wherein a peripheral speed of said wheels of said first group of deceleration wheels is reduced to a speed of between 2 m/sec and 1 m/sec subsequently to the transfer of the respective said vehicle onto said first group.

6. The system according to claim 4, wherein said groups of deceleration wheels includes a second group of deceleration wheels, said wheels of said second group being driven at a peripheral speed of between 2 m/sec and 1 m/sec during a transfer of a respective vehicle from said first group of deceleration wheels, and a peripheral speed of said wheels of said second group being decreased subsequently to the transfer to less than 0.5 m/sec.

7. The system according to claim 6, wherein said wheels of said second group are driven at a constant peripheral speed so as to enable persons to embark or leave the respective vehicle.

8. The system according to claim 6, wherein said wheels of said second group are brought to a standstill so as to enable persons to embark or disembark the respective vehicle.

9. The system according to claim 2, wherein said traction cable is driven at a given traction cable speed, and wherein a last group of said groups of acceleration wheels includes at least ten wheels, said wheels of said last group being driven at a peripheral speed of between 1 m/sec and 2 m/sec during a transfer of a respective one of said vehicles onto said last group, and being subsequently accelerated to the given traction cable speed before connecting the respective vehicle to said traction cable.

10. The system according to claim 8, wherein the given traction cable speed is approximately 8 m/sec.

11. The system according to claim 1, which further comprises a turntable provided in said track between said deceleration wheels and said acceleration wheels, said turntable enabling said vehicles to be turned between a segment of said track extending in a first direction and a segment of said track extending in a second direction.

* * * * *